US011315520B2

(12) United States Patent
Hu et al.

(10) Patent No.: US 11,315,520 B2
(45) **Date of Patent: *Apr. 26, 2022**

(54) DRIVING CIRCUIT

(71) Applicant: Novatek Microelectronics Corp., Hsinchu (TW)

(72) Inventors: Jen-Chieh Hu, Hsinchu County (TW); Chin-Hung Hsu, Taoyuan (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/228,716

(22) Filed: Apr. 13, 2021

(65) Prior Publication Data

US 2021/0233488 A1 Jul. 29, 2021

Related U.S. Application Data

(60) Continuation of application No. 16/858,751, filed on Apr. 27, 2020, now Pat. No. 11,017,740, which is a division of application No. 16/261,588, filed on Jan. 30, 2019, now Pat. No. 10,762,873.

(60) Provisional application No. 62/666,662, filed on May 3, 2018, provisional application No. 62/624,073, filed on Jan. 30, 2018.

(51) Int. Cl.
*G09G 5/00* (2006.01)

(52) U.S. Cl.
CPC ..... *G09G 5/008* (2013.01); *G09G 2330/12* (2013.01)

(58) Field of Classification Search
CPC ..... G09G 5/008; G09G 2310/0291; G09G 2330/06; G09G 2310/06; G09G 2320/08; G09G 2330/12
See application file for complete search history.

(56) References Cited

U.S. PATENT DOCUMENTS

| | | | | |
|---|---|---|---|---|
| 8,237,699 | B2 * | 8/2012 | Hong | G09G 3/2096 345/213 |
| 8,390,614 | B2 * | 3/2013 | Fan | H03L 7/06 345/213 |
| 8,749,535 | B2 | 6/2014 | Kim et al. | |
| 9,049,092 | B2 * | 6/2015 | Sugiyama | G09G 5/008 |
| 10,380,971 | B2 | 8/2019 | Oh et al. | |
| 10,762,873 | B2 * | 9/2020 | Hu | G09G 5/008 |

(Continued)

FOREIGN PATENT DOCUMENTS

| | | |
|---|---|---|
| CN | 103680374 | 3/2014 |
| CN | 105590584 | 5/2016 |

(Continued)

OTHER PUBLICATIONS

Office Action of China Counterpart Application, dated Jan. 13, 2022, pp. 1-18.

*Primary Examiner* — Koosha Sharifi-Tafreshi
(74) *Attorney, Agent, or Firm* — JCIPRNET

(57) ABSTRACT

A driving circuit for driving a display panel is provided. The driving circuit includes a source driver. The source driver is configured to be controlled by a timing controller. The source driver is configured to adjust at least one of an operation frequency and a receiving bandwidth of a source driving circuit of the source driver when at least one of the timing controller and the source driver detects that an interference event occurs.

17 Claims, 13 Drawing Sheets

(56) References Cited

U.S. PATENT DOCUMENTS

| | | | | |
|---|---|---|---|---|
| 11,200,863 | B2 | 12/2021 | Wang | |
| 2010/0085084 | A1 | 4/2010 | Kim et al. | |
| 2010/0231787 | A1* | 9/2010 | Kim | G09G 3/2096 348/503 |
| 2011/0292011 | A1 | 12/2011 | Lee | |
| 2012/0056870 | A1 | 3/2012 | Koh | |
| 2015/0067392 | A1 | 3/2015 | Lim et al. | |
| 2015/0187315 | A1* | 7/2015 | Park | G09G 3/3685 345/99 |
| 2016/0125840 | A1 | 5/2016 | Oh et al. | |
| 2016/0217768 | A1 | 7/2016 | Pyun et al. | |
| 2017/0110078 | A1 | 4/2017 | Kim et al. | |
| 2017/0132966 | A1* | 5/2017 | Lim | G09G 5/18 |
| 2020/0111437 | A1 | 4/2020 | Wang | |

FOREIGN PATENT DOCUMENTS

| | | |
|---|---|---|
| CN | 107154243 | 9/2017 |
| KR | 20100038825 | 4/2010 |
| KR | 20130020073 | 2/2013 |

* cited by examiner

DRIVING CIRCUIT

CROSS-REFERENCE TO RELATED APPLICATION

This application is a continuation application of and claims the priority benefit of U.S. application Ser. No. 16/858,751, filed on Apr. 27, 2020, now pending, which claims the priority benefit of U.S. application Ser. No. 16/261,588, filed on Jan. 30, 2019, which claims the priority benefit of U.S. provisional application Ser. No. 62/624,073, filed on Jan. 30, 2018 and the priority benefit of U.S. provisional application Ser. No. 62/666,662, filed on May 3, 2018. The entirety of each of the above-mentioned patent applications is hereby incorporated by reference herein and made a part of this specification.

BACKGROUND

Field of the Invention

The invention relates to a display apparatus and more particularly, to a driving circuit for driving a display panel.

Description of Related Art

When a mobile phone (or another radio frequency (RF) apparatus) approaches a display apparatus, an RF noise may cause abnormality to a display screen of the display apparatus. One of the reasons that causes the normality is that the RF noise of the mobile phone may probably interfere data signal transmission between a timing controller and a source driving circuit.

FIG. 1 is a schematic diagram illustrating a scenario that a mobile phone 110 approaches a display apparatus 120. A timing controller 121 transmits a data signal to a source driving circuit 122 through a transmission wire, and the source driving circuit 122 drives a display panel according to the data signal to display an image. When the mobile phone 110 approaches the display apparatus 120, a RF noise 111 of the mobile phone 110 may probably interfere data signal transmission between the timing controller 121 and the source driving circuit 122. When an energy of the RF noise in the data signal is large enough, the source driving circuit 122 may probably fail to correctly latch the data signal.

FIG. 2 is a schematic diagram illustrating a scenario that the signal received by the source driving circuit 122 depicted in FIG. 1 is interfered by the RF noise. In FIG. 2, the horizontal axis represents the time. In FIG. 2, Rx represents the data signal received by the source driving circuit 122, and CDR_CLK represents a clock signal of a clock data recovery (CDR) circuit inside the source driving circuit 122. As illustrated in the left part of FIG. 2, when the RF noise 111 does not yet occur, the CDR circuit inside the source driving circuit 122 is capable of correctly locking the data signal Rx, namely, a phase of the data signal Rx may match a phase of the clock signal CDR_CLK. When the RF noise 111 occurs, the RF noise 111 interferes the data signal Rx, which causes the phase of the data signal Rx to not match the phase of the clock signal CDR_CLK. Namely, the CDR circuit inside the source driving circuit 122 may trigger loss of lock to the data signal. When the source driving circuit 122 is incapable of correctly locking the data signal Rx, the display panel of the display apparatus 120 certainly cannot display the correct image.

It should be noted that the content of the section of "Description of Related Art" is used for facilitating the understanding of the invention. A part of the content (or all content) disclosed in the section of "Description of Related Art" may not pertain to the conventional technique known to the persons with ordinary skilled in the art. The content disclosed in the section of "Description of Related Art" does not represent that the content has been known to the persons with ordinary skilled in the art prior to the filing of this invention application.

SUMMARY

The invention provides a driving circuit for self-determining whether or not an interference event occurs to an input signal, so as to determine whether to dynamically adjust an operation frequency of a source driving circuit and/or an operation frequency of a timing control circuit according to a determination result.

According to an embodiment of the invention, a driving circuit for driving a display panel is provided. The driving circuit includes a source driver. The source driver is configured to be controlled by a timing controller. The source driver is configured to adjust at least one of an operation frequency and a receiving bandwidth of a source driving circuit of the source driver when at least one of the timing controller and the source driver detects that an interference event occurs.

To sum up, in the driving circuit provided according to the embodiments of the invention, at least one of the timing controller and the source driver can determine whether or not the interference event occurs to the input signal. When the interference event occurs, the operation frequency of the source driving circuit and/or the operation frequency of the timing controller can be dynamically adjusted.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
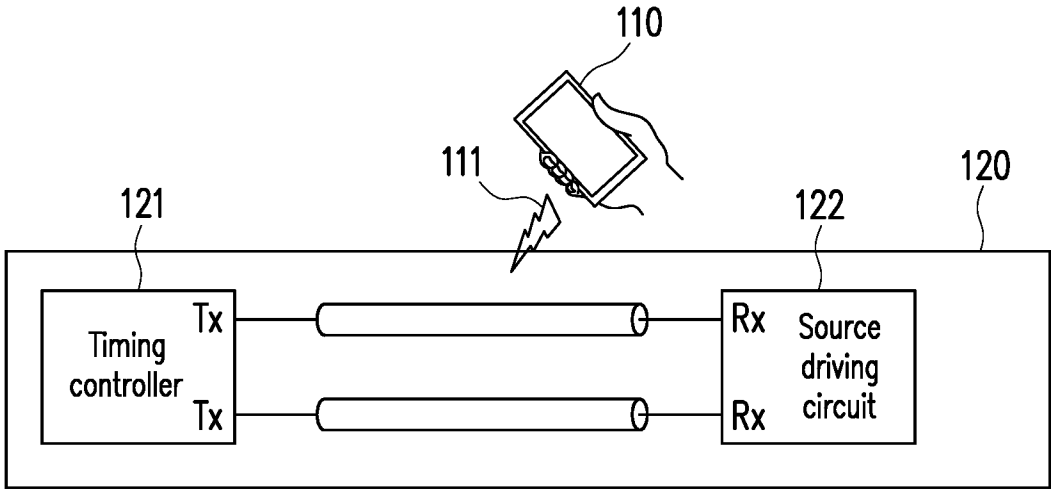
FIG. 1 (RELATED ART)
FIG. 1 is a schematic diagram illustrating a scenario that a mobile phone approaches a display apparatus.

A term "couple" used in the full text of the disclosure (including the claims) refers to any direct and indirect connections. For instance, if a first device is described to be coupled to a second device, it is interpreted as that the first device is directly coupled to the second device, or the first device is indirectly coupled to the second device through other devices or connection means. The terms "first" and "second" mentioned in the full text of the specification (including the claims) are used to name the elements, or for distinguishing different embodiments or scopes, instead of restricting the upper limit or the lower limit of the numbers of the elements, nor limiting the order of the elements. Moreover, wherever possible, components/members/steps using the same referral numerals in the drawings and description refer to the same or like parts. Components/members/steps using the same referral numerals or using the same terms in different embodiments may cross-refer related descriptions.

Figure 3:
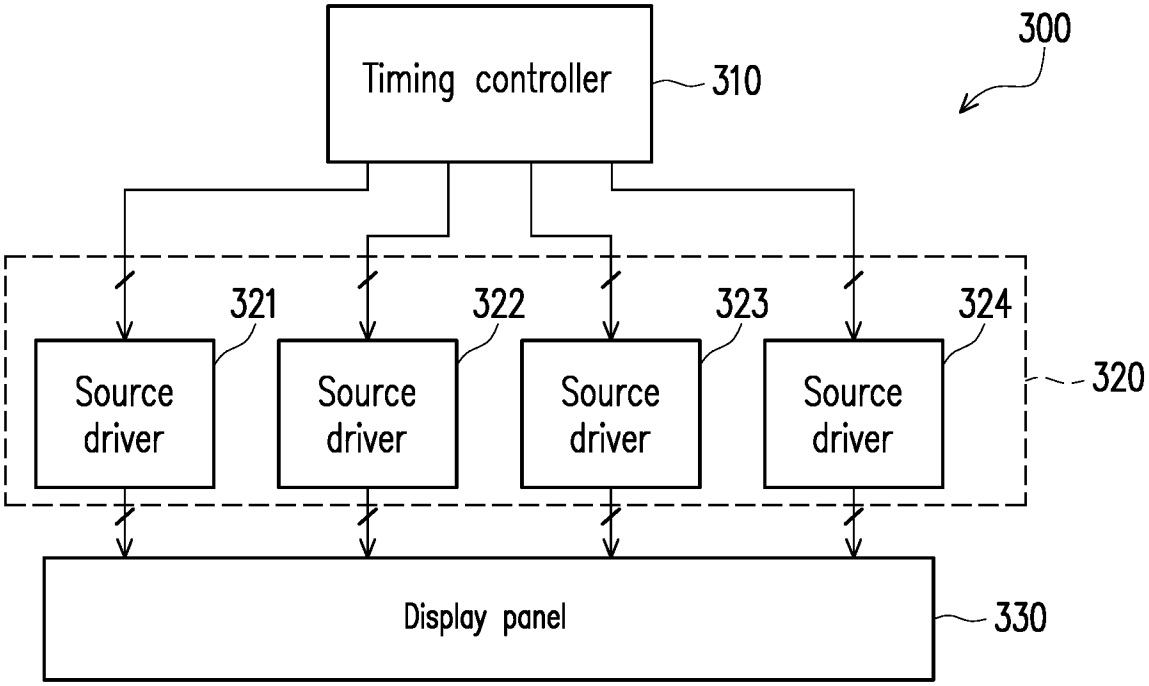
FIG. 3 is a schematic circuit block diagram illustrating a display apparatus according to an embodiment of the invention.

FIG. 3 is a schematic circuit block diagram illustrating a display apparatus 300 according to an embodiment of the invention. The display apparatus 300 includes a driving circuit and a display panel 330. The implementation manner of the display panel 330 is not limited in the invention. Based on a design requirement, for example, the display panel 330 may be a conventional display panel or other display panels. The display apparatus 300 may include one or more integrated circuits, for example, at least one of a timing controller 310 and a driving circuit 320. In some embodiments, the timing controller 310 can be packaged in the driving circuit 320 based on a design requirement. The driving circuit 320 may include one or more source drivers as illustrated in FIG. 3. FIG. 3 illustrates 4 source drivers 321, 322, 323 and 324. In any case, the number of the source drivers may be determined based on a design requirement. The source drivers 321 to 324 are configured to be controlled by the timing controller 310. The timing controller 310 can be configured to transmit data signals to the source drivers 321 to 324 through transmission wires (e.g., wires of a printed circuit board). The source drivers 321 to 324 can comprise respective source driving circuits configured to drive the display panel 330 according to the data signals to display images.

Figure 2:
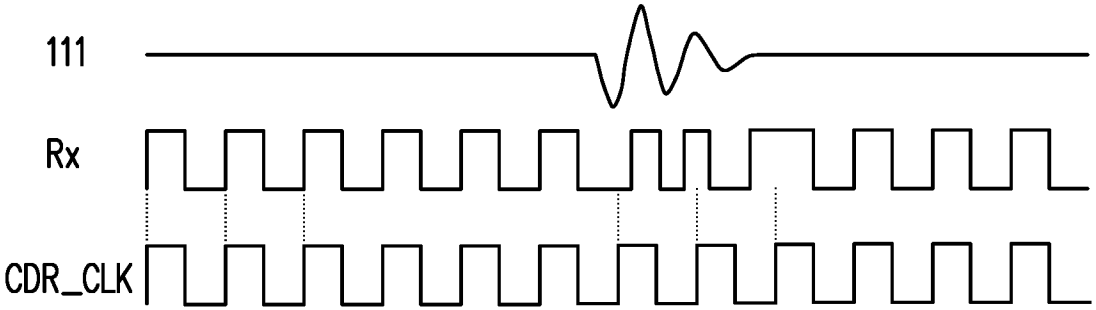
FIG. 2 (RELATED ART)
FIG. 2 is a schematic diagram illustrating a scenario that the signal received by the source driving circuit depicted in FIG. 1 is interfered by a radio frequency (RF) noise.

When an interference event (e.g., the interference scenario illustrated in FIG. 1 and FIG. 2) does not occur, an operation frequency of the timing controller 310 and the source drivers 321 to 324 may be maintained at a normal operation frequency. The operation frequency of the source driving circuit in each of the source drivers 321 to 324 can be indicated by an indication signal received by the source driving circuit from the timing control circuit of the timing controller 310. Specifically, the indication signal can comprise a clock signal or a data signal which can used by the source drivers to generate a clock signal controlling the operation frequency of the source driving circuit in each of the source drivers 321-324. More specifically, in some interfaces such as mini-LVDS interface, the timing controller 310 can be configured to transmit a clock signal to the source drivers 321-324 which then use the clock signal to control an operation frequency of the of the source driving circuits in the source drivers 321-324. In other words, the frequency of the clock signal can be the operation frequency of the source drivers. In some other implementations, such as a P2P (Point to Point) interface, the timing controller is configured to transmit a data signal such as in a format of 11111110000000 which is then received and used by the source drivers to generate a clock signal capable of controlling an operation frequency of the of the source driving circuits in the source drivers 321-324. In other words, the frequency of the data signal can be the operation frequency of the source drivers.

The normal operation frequency may be determined based on a design requirement. When the interference event (e.g., the interference scenario illustrated in FIG. 1 and FIG. 2) occurs, a radio frequency (RF) noise may interfere with transmission of the data signals between the timing controller 310 and the source drivers 321 to 324. At least one of the timing controller 310 or one of the source drivers 321 to 324 can be configured to detect whether the interference event occurs or not. In some embodiments, when the timing controller 310 or any of the source drivers 321 to 324 detects that the interference event occurs, the source drivers 321 to 324 may adjust the operation frequency of the source drivers 321 to 324 from the normal operation frequency to at least one anti-interference frequency. More specifically, the timing controller 310 may adjust the frequency of the indication signal (i.e., the data signal or the clock signal) and the source drivers 321-324 can then adjust the operation frequency of the source driving circuits thereof according to the received input signal, to the at least one anti-interference frequency. In summary, when the interference event disappears, the operation frequency of the source drivers 321 to 324 may be adjusted from the at least one anti-interference frequency to the normal operation frequency.

For example, in some embodiments, the timing controller 310 may detect whether or not the interference event occurs. When the timing controller 310 detects that the interference event occurs, the timing controller 310 may send an indication signal to the source drivers 321 to 324. The indication signal may indicate whether or not the timing controller 310 detects that the interference event occurs. Additionally or alternatively, the indication signal may indicate one of at least one anti-interference frequency. The indication signal may be a data signal or a clock signal. The source drivers 321 to 324 may receive the indication signal from the timing controller 310 and adjust the operation frequency of the source driving circuit based on the indication signal from the normal operation frequency to the one of the at least one anti-interference frequency. In some other embodiments, each of the source drivers 321 to 324 may receive an input signal (e.g., the data signal) from the timing controller 310. Each of the source drivers 321 to 324 may detect whether or not the interference event occurs to the input signal. When a source driver (e.g., one of the source drivers 321 to 324) detects that the interference event occurs, the source driver may inform the timing controller 310. The timing controller 310, informed by the source driver of the occurrence of the interference event by the source driver, may send an indication signal to the source drivers 321 to 324. The indication signal may indicate whether or not the timing controller 310 detects that the interference event occurs. Additionally or alternatively, the indication signal may indicate one of at least one anti-interference frequency. The indication signal may be a data signal or a clock signal. The source drivers 321 to 324 may receive the indication signal from the timing controller 310 and adjust the operation frequency of the source driving circuit based on the indication signal from the normal operation frequency to the one of the at least one anti-interference frequency.

In some embodiments, each of the source drivers 321 to 324 may detect whether or not the interference event occurs. When one of the source drivers 321 to 324 detects that the interference event occurs, the source driving circuit generates a feedback signal to the timing controller 310. The feedback signal is provided to the timing controller 310 which than provides an indication signal to the source drivers to adjust the operation frequency of the source drivers 321 to 324. Based on a design requirement, the feedback signal may be a hardware pin signal or other types of signals. For example (but not limited), when the feedback signal is a logic high signal, the feedback signal may indicates that "the interference event occurs", and when the feedback signal is a logic low signal, the feedback signal may indicate "no interference event occurs". Alternatively, the feedback signal may be a differential signal. When the feedback signal is in a first logic state, the feedback signal may indicate "the interference event occurs", and when the feedback signal is in a second logic state, the feedback signal may indicate "no interference event occurs". Alternatively, the feedback signal may be a differential signal including a first end signal and a second end signal. When the first end signal and the second end signal are mutually inverted, i.e., the first end signal and the second end signal are inverted to each other, the feedback signal may indicate that "no interference event occurs", and when the first end signal and the second end signal in phase with each other, the feedback signal may indicate that "the interference event occurs".

In some other embodiments, each of the source drivers 321 to 324 may receive the input signal (e.g., the data signal) from the timing controller 310. The timing controller 310 may detect whether or not the interference event occurs to the input signal. When the timing controller 310 detects that the interference event occurs, the timing controller 310 than provides an indication signal to the source drivers to adjust the operation frequency of the source drivers 321 to 324.

Figure 4:
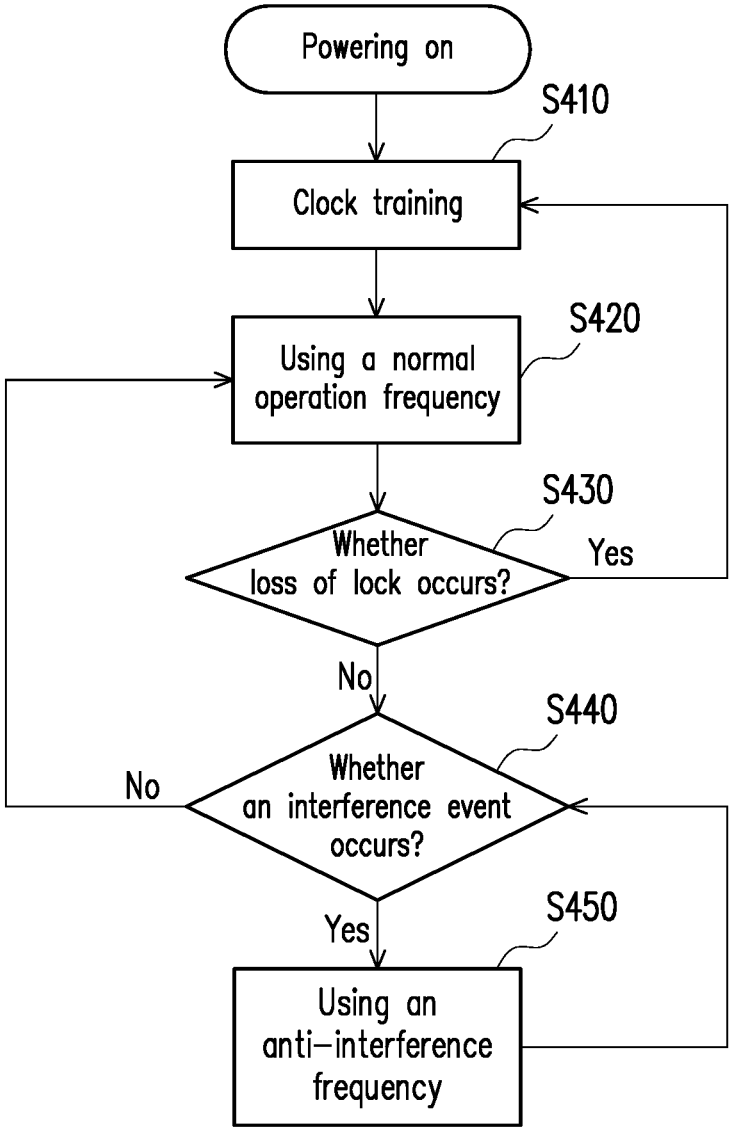
FIG. 4 is a flowchart illustrating an anti-interference method of a driving circuit according to an embodiment of the invention.

FIG. 4 is a flowchart illustrating an anti-interference method of a driving circuit according to an embodiment of the invention. Referring to FIG. 3 and FIG. 4, after the timing controller 310 and the source drivers 321 to 324 are powered on, the timing controller 310 and the source drivers 321 to 324 enter a clock training mode (step S410). In the clock training mode, the timing control circuit of the timing controller 310 serves a clock training data string as a data signal and transmits it to each of the source drivers 321 to 324. Operation details in the clock training mode are not limited in the present embodiment. For example, the operation details related to the clock training mode may be a conventional clock training operation or other operations. In this circumstance, a clock data recovery (CDR) circuit (not shown) inside each of the source drivers 321 to 324 may perform a frequency lock operation and/or a phase lock operation on the clock training data string provided by the timing controller 310.

After the clock training mode ends, the CDR circuit of each of the source drivers 321 to 324 is capable of correctly locking the clock training data string provided by the timing control circuit of the timing controller 310, and thus, the timing controller 310 and the source drivers 321 to 324 enter a normal mode (step S420). In the normal mode, the operation frequency of each of the source drivers 321 to 324 is set to the normal operation frequency. The normal operation frequency may be determined based on a design requirement. The CDR circuit inside each of the source drivers 321 to 324 may trigger loss of lock to the data signal. When the CDR circuit triggers loss of lock to the data signal (i.e., the determination result of step S430 is "Yes"), the normal mode ends to return to the clock training mode (step S410). When the CDR circuit does not trigger loss of lock to the data signal (i.e., the determination result of step S430 is "No"), the timing controller 310 and the source drivers 321 to 324 are maintained in the normal mode, and at least one of the timing controller 310 or one of the source drivers 321 to 324 may detect whether or not an interference event occurs (step S440). When the interference event does not occur (i.e., the determination result of step S440 is "No"), step S420 and step S430 are again performed. Namely, the timing control circuit of the timing controller 310 transmits the data signal to the one of the source driving circuits of the source drivers 321 to 324 operating at the normal operation frequency.

Figure 5:
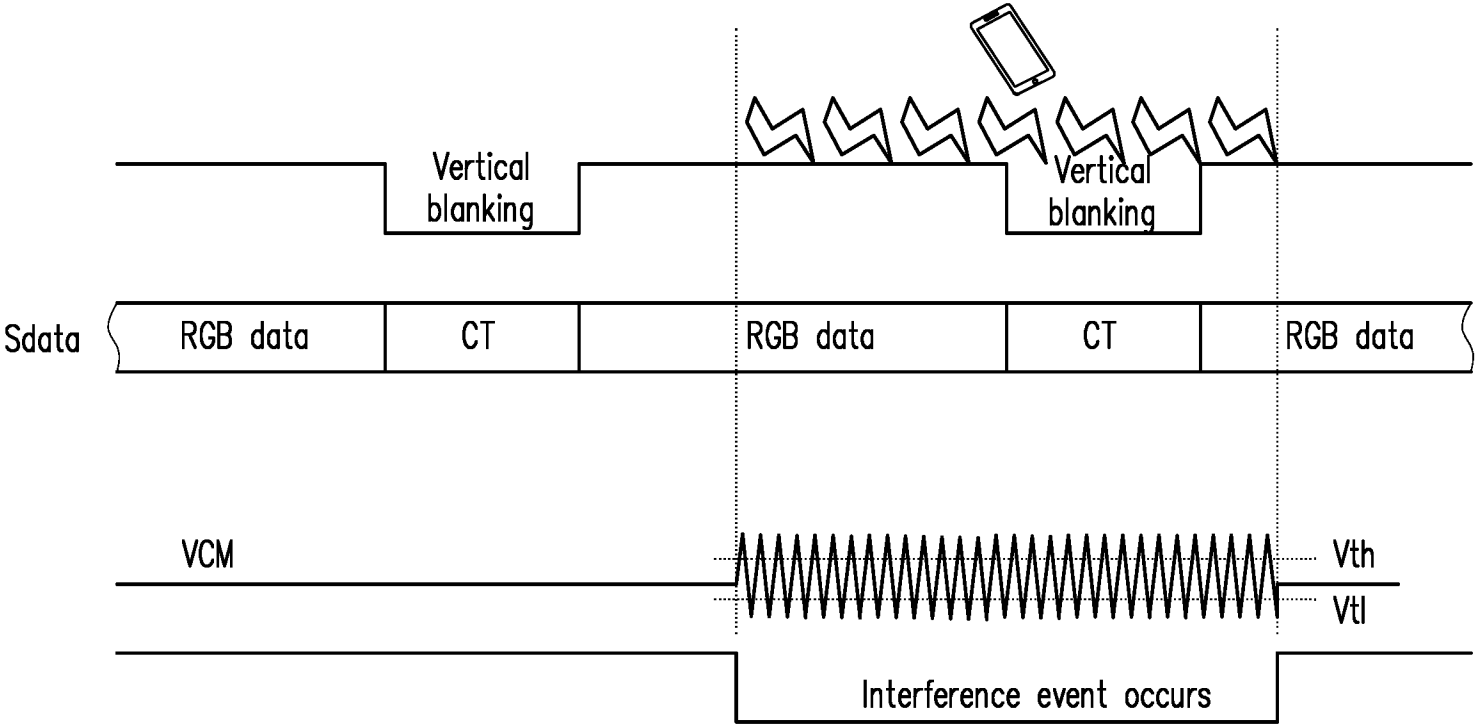
FIG. 5 is a schematic signal timing diagram illustrating that an interference event occurs according to an embodiment of the invention.

FIG. 5 is a schematic signal timing diagram illustrating that an interference event occurs according to an embodiment of the invention. Referring to FIG. 3 and FIG. 5, the timing controller 310 transmits a data signal Sdata to one of the source drivers 321 to 324 operating at the normal operation frequency. In an active period, the timing controller 310 serves RGB data (sub-pixel data) as the data signal Sdata and a control command and transmit them to one of the source drivers 321 to 324. In a vertical blanking period, the timing controller 310 serves a clock training data string CT as the data signal Sdata to transmit it to one of the source drivers 321 to 324 for clock training.

When an interference event (e.g., the interference scenario illustrated in FIG. 1 and FIG. 2) occurs, a RF noise may interfere transmission of the data signal Sdata between the timing controller 310 and the source drivers 321 to 324, which causes a common-mode level VCM of a common mode voltage of the data signal Sdata to change, i.e., a ripple occurs to the common mode voltage. At least one of the timing controller 310 and the source drivers 321 to 324 may detect the common-mode level VCM of the data signal Sdata. A high threshold Vth and a low threshold Vtl may be set based on a design requirement in the present embodiment. When the common-mode level VCM is greater than the high threshold Vth and/or less than the low threshold Vtl, the timing controller 310 (or one of the source drivers 321 to 324) may determine that "the interference event occurs" (i.e., the determination result of step S440 is "Yes"). Otherwise, when the common-mode level VCM is not greater than the high threshold Vth nor less than the low threshold Vtl, the timing controller 310 (or one of the source drivers 321 to 324) may determine that "no interference event occurs" (i.e., the determination result of step S440 is "No").

For example, each of the source drivers 321 to 324 may detect the common-mode level VCM of the data signal Sdata (i.e., the input signal) transmitted from the timing controller 310 to each of the source drivers 321 to 324. According to the common-mode level, each of the source drivers 321 to 324 may determine whether or not any interference event occurs and feedback a feedback signal related to the interference event to the timing controller 310.

In any case, the determination of step S440 should not be limited to the embodiments described above. For example, in some other embodiments, each of the source drivers 321 to 324 may process the data signal Sdata (i.e., the input signal) transmitted from the timing controller 310 to each of the source drivers 321 to 324 according to at least one operation parameter to generate output data. Each of the source drivers 321 to 324 may detect an error code count of the output data. The source drivers 321 to 324 may determine whether or not the interference event occurs according to the error code count. For example, when the error code count is greater than a certain threshold (which may be determined based on a design requirement), the source drivers 321 to 324 may determine that an interference event occurs. The source drivers 321 to 324 may feedback a feedback signal related to the interference event to the timing controller 310.

Referring to FIG. 4, when the interference event occurs (i.e., the determination result of step S440 is "Yes"), the operation frequency of each of the source drivers 321 to 324 may be adjusted from the normal operation frequency to the at least one anti-interference frequency (step S450). For example, in a condition that a noise frequency of the interference event is greater than a frequency of the data signal Sdata, the operation frequency of each of the source drivers 321 to 324 may be reduced to mitigate affection caused by the noise to the data signal Sdata. In a condition that the noise frequency of the interference event is less than the frequency of the data signal Sdata, the operation frequency of each of the source drivers 321 to 324 may be increased to mitigate the affection caused by the noise to the data signal Sdata.

In the embodiment that the source drivers 321 to 324 may provide the feedback signal related to the interference event to the timing controller 310, when this feedback signal indicates that the interference event occurs in a first vertical blanking period, the timing controller 310, in step S450, may provide an indication signal (the data signal or clock signal) to the source drivers 321-324 for adjusting the operation frequency of the source drivers 321-324 from the normal operation frequency to a first anti-interference frequency to mitigate the affection caused by the noise to the data signal Sdata. After step S450 is completed, the process returns to step S440 again. When the feedback signal indicates that the interference event occurs in a second vertical blanking period after the first vertical blanking period (i.e., the determination result of step S440 is again "Yes"), the timing controller 310 may provide the indication signal (the data signal or clock signal) to the source drivers 321-324 for adjusting the operation frequency of the source drivers 321-324 from the first anti-interference frequency to a second anti-interference frequency to mitigate the affection caused by the noise to the data signal Sdata.

After step S450 is completed, the process returns to step S440 again. When the feedback signal indicates that no interference event occurs in the second vertical blanking period after the first vertical blanking period (i.e., the determination result of step S440 is "No"), the timing controller 310 may provide the indication signal (the data signal or clock signal) to the source drivers 321-324 for adjusting the operation frequency of the the source drivers 321-324 from the first anti-interference frequency to the normal operation frequency (step S420).

Further, for example, in some embodiments, the timing controller 310, in step S440, may detect the common-mode level VCM of the data signal Sdata (i.e., the input signal) transmitted from timing controller 310 to one of the source drivers 321 to 324. According to this common-mode level, the timing controller 310 may determine whether or not the interference event occurs. When the common-mode level VCM is greater than the high threshold Vth or less than the low threshold Vtl, the timing control circuit may determine that the interference event occurs. When the interference event occurs to the data signal Sdata (i.e., the input signal), the timing controller 310 may reduce the frequency of the data signal Sdata in the condition that the noise frequency of the interference event is greater than the frequency of the data signal Sdata. When the interference event occurs to the data signal Sdata (i.e., the input signal), the timing controller 310 may increase the frequency of the data signal Sdata in the condition that the noise frequency of the interference event is less than the frequency of the data signal Sdata. The timing controller 310 may provide the data signal Sdata as the indication signal to the source drivers 321 to 324 which can then, based on the data signal Sdata, generate a clock signal having the frequency of the data signal Sdata, and the source drivers 321-324. Accordingly, the source drivers 321-324 can operate at the first anti-interference frequency adjusted from the normal operation frequency.

After step S450 is completed, step S440 is again returned to. When the timing controller 310 determines that no interference event occurs (i.e., the determination result of step S440 is "No"), the timing controller 310 may provide the data signal Sdata as the indication signal to the source drivers 321 to 324 which can then, based on the data signal Sdata, generate a clock signal having the frequency of the data signal Sdata, and the source drivers 321-324. Accordingly, the source drivers 321-324 can operate at the normal operation frequency adjusted from the first anti-interference frequency (step S420).

Figure 6:
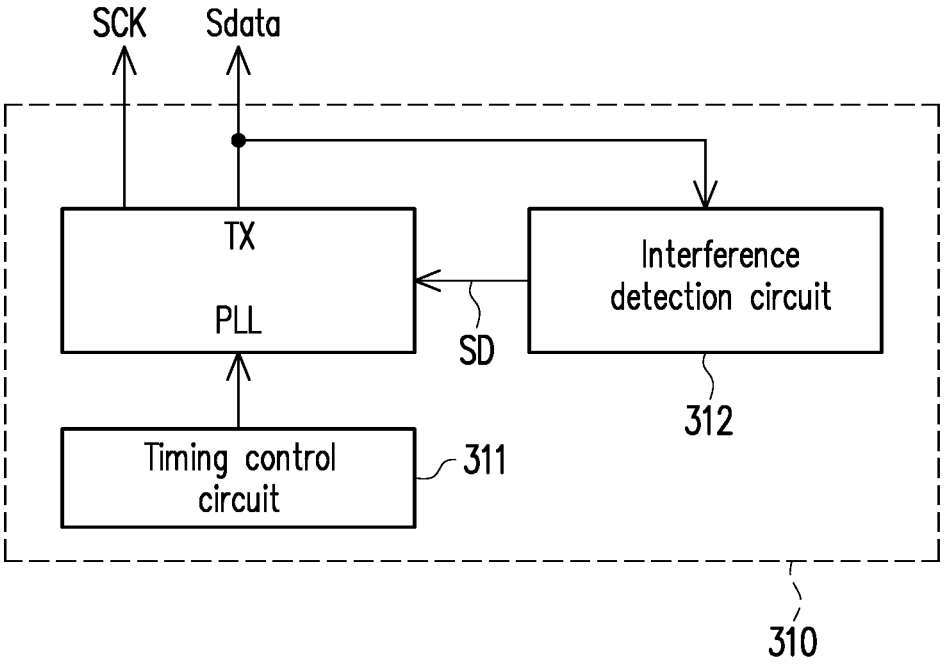
FIG. 6 is a schematic circuit block diagram illustrating a timing controller according to an embodiment of the invention.

FIG. 6 is a schematic circuit block diagram illustrating a timing controller 310 according to an embodiment of the invention. The timing controller 310 illustrated in FIG. 3 may be inferred with reference to the description related to the timing controller 310 illustrated in FIG. 6. The timing controller 310 illustrated in FIG. 6 includes a timing control circuit 311 and an interference detection circuit 312. In some interfaces such as P2P (Point to Point) interface, the timing control circuit 311 may be coupled to the source drivers 321 to 324 to provide the data signal Sdata. In some other interfaces such as mini-LVDS, the timing control circuit 311 may also provide a clock signal SCK. The interference detection circuit 312 is configured to detect whether an interference event occurs and generates a detection signal SD indicating whether or not the interference event occurs. The timing control circuit 311 may comprise or be coupled to a PLL circuit, which can be coupled to the interference detection circuit 312 to receive the detection signal SD. The PLL circuit can adjust a frequency of a data signal (or a clock signal) according to the detection signal SD. The timing control circuit 311 may be further configured to control a TX circuit, which can be configured to provide the data signal (or the clock signal) to the source drivers 321-324, wherein the data signal (or clock signal) can be served as an indication signal for adjusting an operation frequency of the source drivers 321-324.

More specifically, the interference detection circuit 312 is configured to detect an input signal (e.g., the data signal Sdata) transmitted from the timing control circuit 311 to the source driving circuits of the source drivers 321 to 324. The interference detection circuit 312 can be configured to determine whether or not the interference event occurs according the input signal (e.g., the data signal Sdata). In one embodiment, the interference detection circuit 312 is configured to detect a common-mode level of the input signal (e.g., the data signal Sdata), and determines whether or not the interference event occurs according to the common-mode level of the input signal.

It is noted that although the interference detection circuit 312 is shown to be coupled to the PLL circuit to provide the detection signal SD to the PLL circuit, the disclosure is not limited thereto. For example, the interference detection circuit 312 may be configured to provide the detection signal SD to the timing control circuit 311 which then controls the PLL circuit to generate the data signal Sdata or the clock signal SCK according to the detection result indicated by the detection signal SD. Moreover, in the same or alternative embodiments, the timing control circuit 311, the PLL circuit, and the interference detection circuit 312 can be (partially or wholly) separated or integrated.

Figure 7:
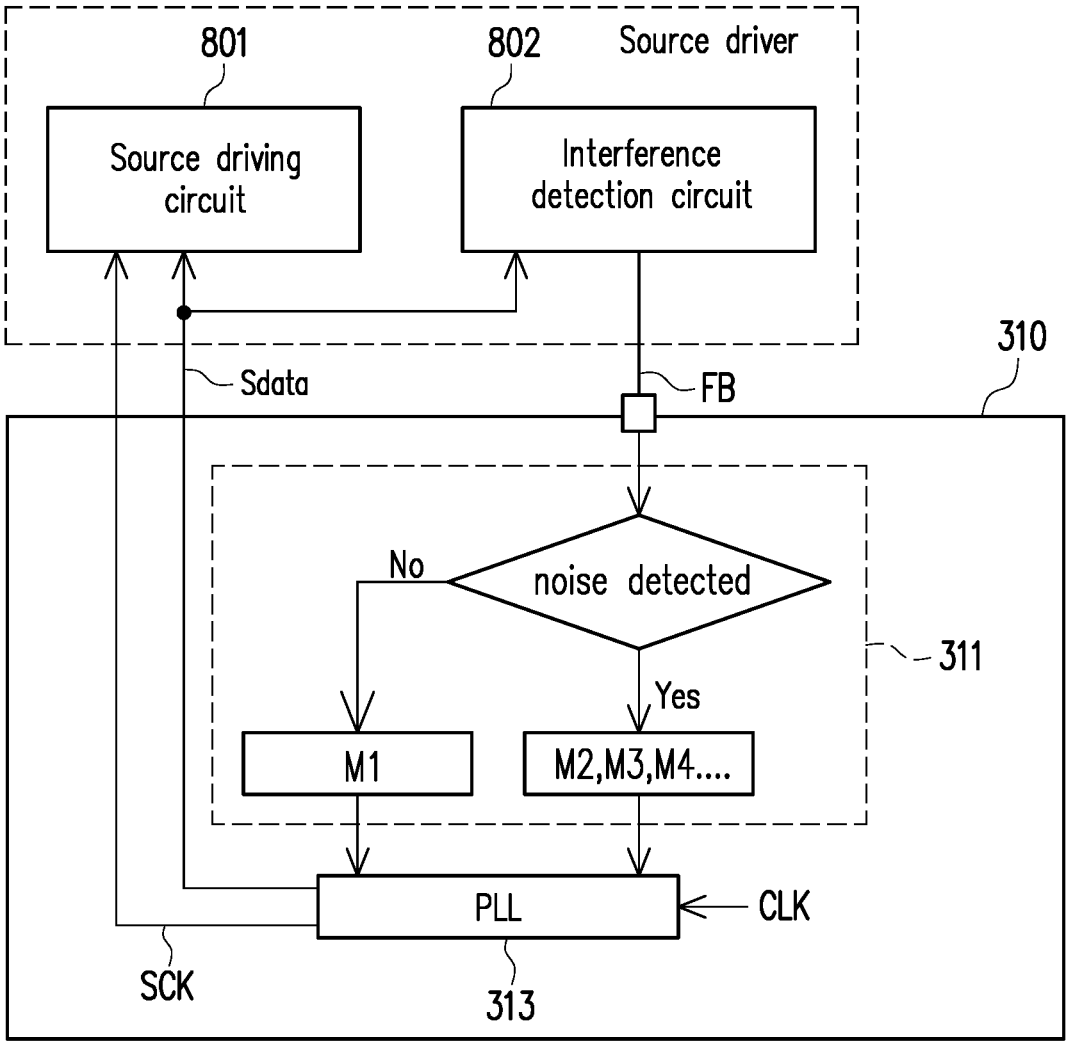
FIG. 7 is a schematic circuit block diagram illustrating a timing controller according to another embodiment of the invention.

FIG. 7 is a schematic circuit block diagram illustrating a timing controller 310 and a source driver according to another embodiment of the invention. The timing controller 310 illustrated in FIG. 3 may be inferred with reference to the description related to the timing controller 310 illustrated in FIG. 7. The timing controller 310 illustrated in FIG. 7 includes a timing control circuit 311 which can comprise or be coupled to a PLL circuit 313. For example, an output terminal of the timing control circuit 311 is coupled to the PLL circuit 313. An input terminal of the timing control circuit 311 may be coupled to the source drivers 321 to 324 to receive a feedback signal FB. In the embodiment of FIG. 7, each of the source drivers 321 to 324 includes a source driving circuit 801 and an interference detection circuit 802. The source driving circuit 801 is configured to receive an input signal (e.g., the data signal Sdata) from the timing controller 310. The interference detection circuit 802 is configured to detect whether an interference event occurs to the input signal and generates a detection signal indicating whether or not the interference event occurs. The source driver can then provide the detection signal as a feedback signal FB to the timing controller 310.

The timing control circuit 311 can be coupled to the interference detection circuit 802 to receive the feedback signal FB when the interference event occurs. The timing control circuit 311 adjusts the operation frequency of a data signal or a clock signal according to the feedback signal FB. For example, when the feedback signal FB indicates "no noise detected", the timing control circuit 311 provides a frequency value "M1" to the PLL circuit 313. When the feedback signal FB indicates "noise detected", the timing control circuit 311 provides one of frequency values "M2", "M3", "M4" and/or other value to the PLL circuit 313.

The PLL circuit 313 is configured to receive the frequency value and generate a data signal Sdata or a clock signal SCK according to the frequency value. The data signal Sdata or the clock signal SCK can then be provided to the source driving circuits of the source drivers 321 to 324. Assuming that the frequency of the system clock CLK is F, and the frequency value provided by the timing control circuit 311 is M1, the frequency (the normal operation frequency) of the clock signal SCK output by the PLL circuit 313 is F*M1/N, where N is the frequency division value of the PLL circuit 313. Assuming that the frequency value provided by the timing control circuit 311 is M2, the frequency (the anti-interference frequency) of the clock signal SCK output by the PLL circuit 313 is F*M2/N. It is noted that in different embodiments, a timing control circuit 311 can be partially or wholly integrated with the interference detection circuit 802. For example, the source driver may provide a feedback signal indicating the frequency values M1, M2, and etc. to the timing controller 310 such that the timing controller 310 may not need to judge the frequency values.

Figure 8:
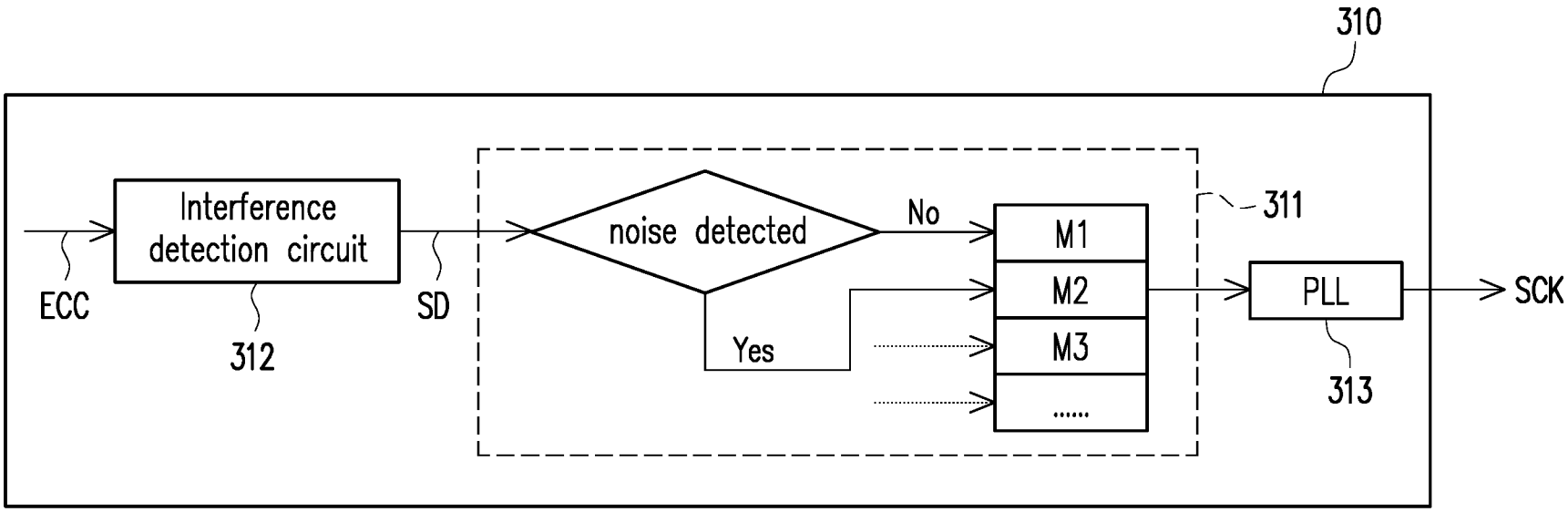
FIG. 8 is a schematic circuit block diagram illustrating a timing controller according to another embodiment of the invention.

FIG. 8 is a schematic circuit block diagram illustrating a timing controller 310 according to another embodiment of the invention. The timing controller 310 illustrated in FIG. 3 may be inferred with reference to the description related to the timing controller 310 illustrated in FIG. 8. Each of the source drivers 321 to 324 may detect an error code count ECC of the output data of the source driving circuit. The source drivers 321 to 324 provide the error code count ECC to the timing controller 310. The timing controller 310 illustrated in FIG. 8 includes a timing control circuit 311 and a PLL circuit 313 which may be separated from or integrated with the timing control circuit 311. For example, an output terminal of the timing control circuit 311 may be coupled to the PLL circuit 313 as shown. The timing controller 310 can further comprise an interference detection circuit 312 which can be separated from or integrated with the timing control circuit 311. An input terminal of the interference detection circuit 312 may be coupled to the source drivers 321 to 324 to receive the error code count ECC. The interference detection circuit 312 may determine whether or not the interference event occurs according to the error code count ECC. For example, when the error code count ECC is greater than a certain threshold (which may be determined based on a design requirement), the interference detection circuit 312 may determine that an interference event occurs and generate a detection signal SD which then provide to the timing control circuit 311. For example, when the interference detection circuit 312 determines based on the error code count ECC that "no noise is detected", the interference detection circuit 313 provides the detection signal SD indicating the detection result to the timing control circuit 311, which then provides a frequency value "M1" to the PLL circuit 313. Conversely, when the inference detection circuit 312 determines based on the ECC that "noise is detected," the interference detection circuit 313 provides the detection signal SD indicating the detection result to the timing control circuit 311, which then provides one of frequency values "M2", "M3", "M4" and/or other value to the PLL circuit 313.

Figure 9:
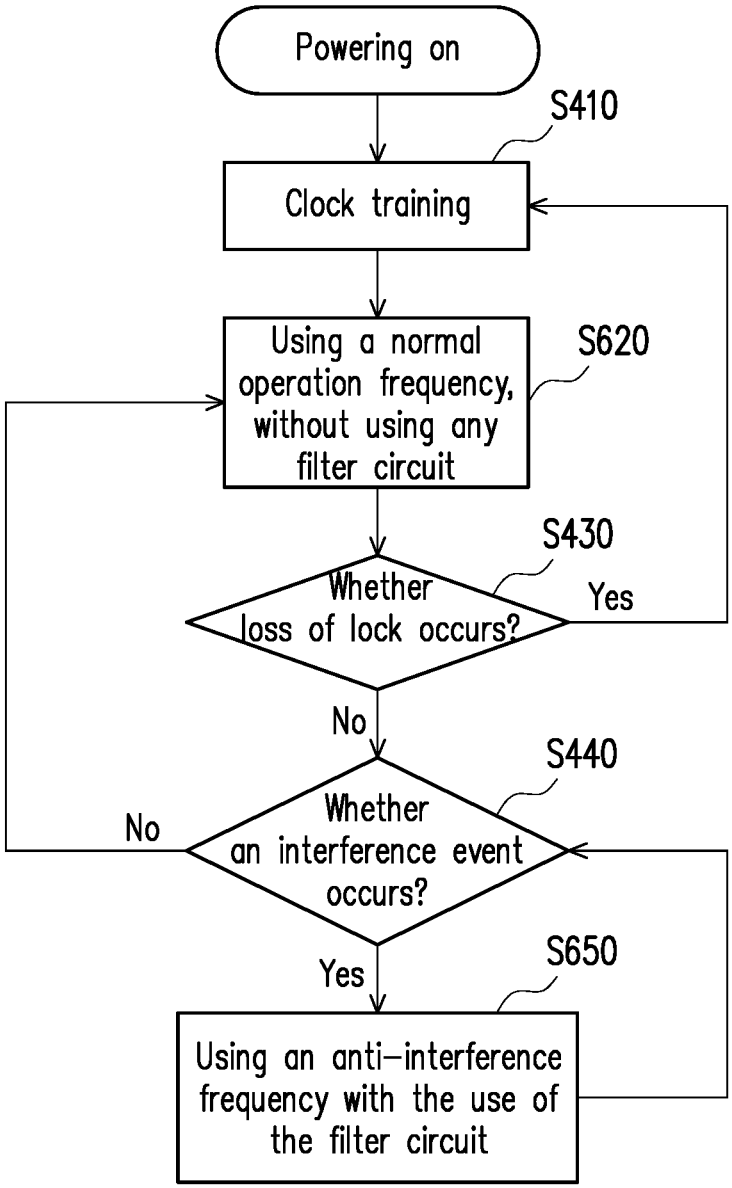
FIG. 9 is a flowchart illustrating an anti-interference method of a driving circuit according to another embodiment of the invention.

FIG. 9 is a flowchart illustrating an anti-interference method of a driving circuit according to another embodiment of the invention. Step S410, step S430 and step S440 illustrated in FIG. 9 may be inferred with reference to the related descriptions of FIG. 4 and will not be repeated. Referring to FIG. 3 and FIG. 9, after the clock training mode ends, the CDR circuit (not shown) of each of the source drivers 321 to 324 may correctly lock the clock training data string CT provided by the timing controller 310, and thus, the timing controller 310 and the source drivers 321 to 324 enters the normal mode (step S620).

Alternatively or additionally, any one of the source drivers 321 to 324 may adjust a receiving bandwidth of the source driving circuit when at least one of the timing control circuit and the source driving circuit detects that an interference event occurs. In other words, in some embodiments, when an interference event occurs, any of the source drivers can adjust an operation frequency of a source driving circuit thereof without adjusting a receiving bandwidth of the source driving circuit. In some other embodiments, when an interference event occurs, any of the source drivers can adjust a receiving bandwidth of a source driving circuit thereof without adjusting an operation frequency of the source driving circuit. In further other embodiments, when an interference event occurs, any of the source drivers can adjust a receiving bandwidth and an operation frequency of the source driving circuit.

To achieve adjusting of a receiving bandwidth, there may be various implementations. In some embodiments, each of the source drivers can further include a filter circuit (not shown). In the normal mode (step S620), the operation frequency of each of the source drivers 321 to 324 is set to the normal operation frequency, and the one of the source drivers 321 to 324 do not filter the data signal Sdata with the use of the filter circuit (not shown). The normal operation frequency may be determined based on a design requirement. Step S620 illustrated in FIG. 9 may be inferred with reference to the description related to step S420 illustrated in FIG. 4, and thus, other details will not be repeatedly described. In another embodiment, the one of the source drivers 321 to 324 may filter the data signal Sdata with the use of the filter circuit (not shown) in the normal mode (step S620), but may set an operation parameter of the filter circuit to be "all pass".

When an interference event occurs (i.e., the determination result of step S440 is "Yes"), the operation frequency of the one of the source drivers 321 to 324 (and/or the operation frequency of the timing controller 310) may be adjusted from the normal operation frequency to the at least one anti-interference frequency (step S650). Step S650 illustrated in FIG. 9 may be inferred with reference to the description related to step S450 illustrated in FIG. 4 and thus, other details will not be repeatedly described. In addition, the one of the source drivers 321 to 324, in step S650, may also filter the data signal Sdata with the use of the filter circuit (not shown). In other words, the one of the source drivers 321 to 324 may enable a filtering operation to avoid a frequency band of the interference event. In addition to enabling the filtering operation, the one of the source drivers 321 to 324 may further adjust a bandwidth of the filter circuit to avoid a frequency band of the interference event. It is noted that in alternative embodiments, steps S620 and steps 650, the operation frequency can be both set at the normal operation frequency, with the difference between steps S620 and 650 being whether the filter circuit enabled or not.

Figure 10:
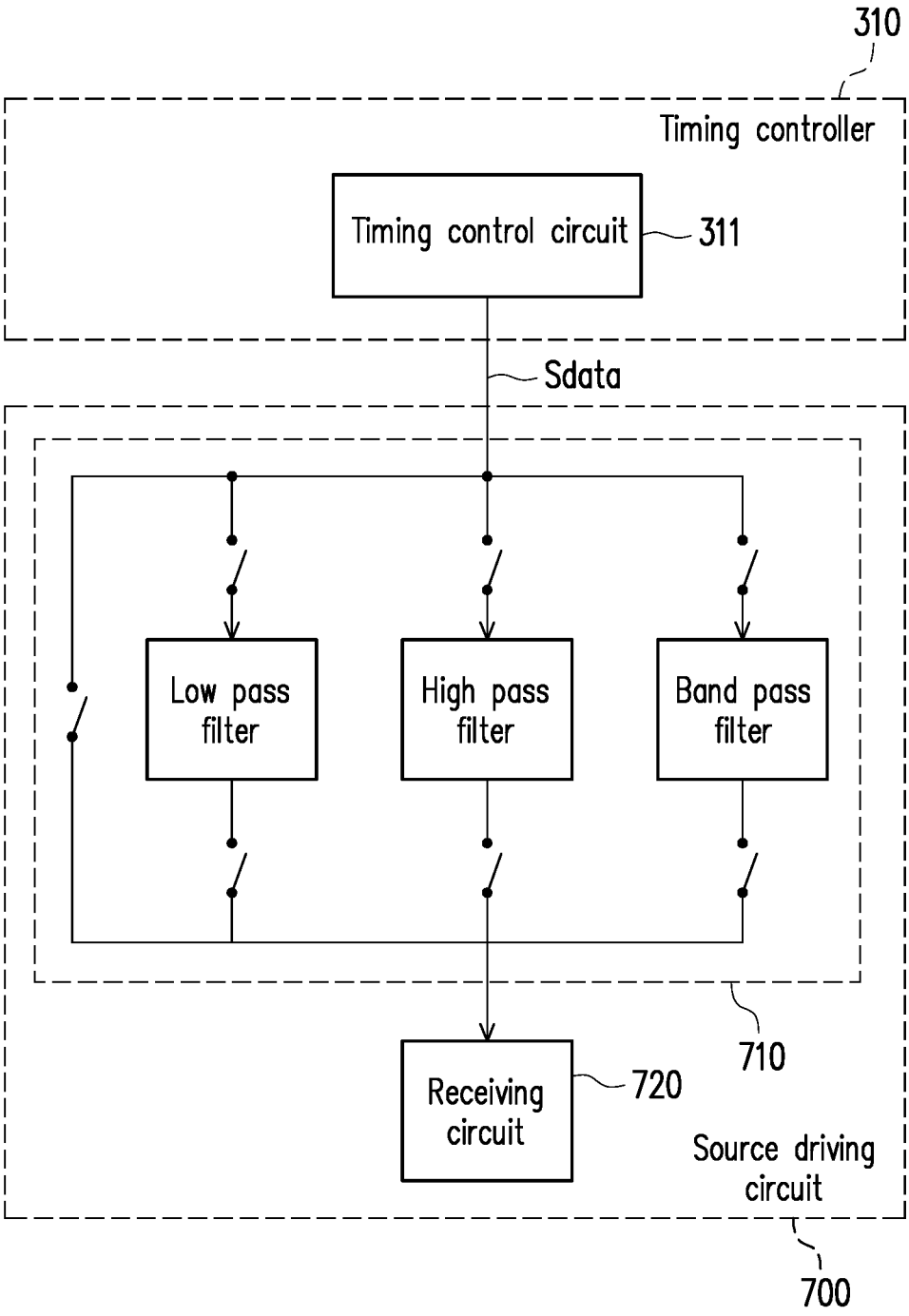
FIG. 10 is a schematic circuit block diagram illustrating a source driving circuit according to an embodiment of the invention.

FIG. 10 is a schematic circuit block diagram illustrating a source driving circuit 700 according to an embodiment of the invention. Any of the source driving circuits of the source drivers 321 to 324 illustrated in FIG. 3 may be inferred with reference to the description related to the source driving circuit 700 illustrated in FIG. 10. The source driving circuit 700 comprises an input terminal configured to be coupled to the timing control circuit 311. The receiving circuit 720 comprises a phase locked loop (PLL) circuit (not shown) coupled to the input terminal of the source driving circuit 700. For example, the source driving circuit 700 illustrated in FIG. 10 includes a filter circuit 710 and a receiving circuit 720. An input terminal of the filter circuit 710 may be coupled to the timing control circuit 311 of the timing controller 310 to receive an input signal (e.g., the data signal Sdata) from the timing control circuit 311. An input terminal of the receiving circuit 720 is coupled to an output terminal of the filter circuit 710.

When no interference event occurs, the output terminal of the filter circuit 710 provides the data signal Sdata (i.e., the input signal) to the input terminal of the receiving circuit 720. The operation of the filter circuit 710 can be adjusted, for example, to have different bandwidths, based on at least one of whether interference events occur or not and noise frequencies of interference events. In some embodiments, when the interference event occurs to the data signal Sdata (i.e., the input signal), the filter circuit 710 performs a corresponding filtering operation to filter a noise of the interference event to generate a filtered signal. The filter circuit 710 can be configured not to perform a filtering operation on the input signal received by the source driving signal when the interference event does not occur. The bandwidth of the filter circuit 710 can be further configured to be adjusted based on a noise frequency of the interference event when the interference event occurs. The output terminal of the filter circuit 710 provides the filtered signal to the input terminal of the receiving circuit 720.

Based on a design requirement, the filter circuit 710 may include a plurality of filters configured to filter the input signal received from (or coupled to) the timing control circuit 311. FIG. 10 also shows a detailed structure of the filter circuit 710 according to an exemplary implementation. In the exemplary implementation, the filter circuit 710 includes one or more filters respectively configured to perform different filtering operations, which for example as shown, can include a low-pass filtering operation, a high-pass filtering operation and/or a band-pass filtering operation. Different corresponding filtering operations can be performed respectively when different conditions of interference detection occur. More specifically, when the interference event occurs to the data signal Sdata (i.e., the input signal), in a condition that the noise frequency of the interference event is greater than the frequency of the data signal Sdata, the filter circuit 710 may perform the low-pass filtering operation (or any corresponding filtering operation) on the data signal Sdata with the use of a low pass filter (or any corresponding filter) and then provide the filtered signal to the input terminal of the receiving circuit 720. When the interference event occurs to the data signal Sdata (i.e., the input signal), in a condition that the noise frequency of the interference event is less than the frequency of the data signal Sdata filter circuit 710 may perform the high-pass filtering operation (or any corresponding filtering operation) on the data signal Sdata with the use of a high pass filter (or any corresponding filter) and then provide the filtered signal to the input terminal of the receiving circuit 720. In some particular application scenarios, when the interference event occurs to the data signal Sdata (i.e., the input signal), the filter circuit 710 may perform the band-pass filtering operation (or any corresponding filtering operation) on the data signal Sdata with the use of a band pass filter (or any corresponding filter) and then provide the filtered signal to the input terminal of the receiving circuit 720.

The receiving bandwidth of the source driving circuit 700 is adjusted before the receiving circuit in the above embodiment but the disclosure is not limited thereto. In other embodiments, the receiving bandwidth of the source driving circuit 700 may be adjusted within the receiving circuit. In an example where the receiving bandwidth of the source driving circuit 700 is adjusted within the receiving circuit, the receiving circuit 720 may process a signal of the output terminal of the filter circuit 710 (which may be, for example, the data signal S data or the filtered signal) based on at least one operation parameter, so as to generate output data. For example, the at least one operation parameter may include a bandwidth. In some embodiments, the bandwidth is not related to whether or not the interference event occurs. In some other embodiments, the bandwidth may be dynamically adjusted depending on whether or not the interference event occurs. For example, when the interference event does not occur, the bandwidth of the receiving circuit 720 is set to a first bandwidth. When the interference event occurs to the data signal Sdata (i.e., the input signal), the bandwidth of the receiving circuit 720 is decreased from the first bandwidth down to a certain corresponding bandwidth. More details about adjusting the bandwidth of the receiving circuit can be referred to FIGS. 15-17.

In summary, a receiving bandwidth the source driving circuit of the source driver may be adjusted by adjusting a bandwidth of a filter disposed before a receiving circuit of the source driving circuit and/or a bandwidth of the receiving circuit.

Figure 11:
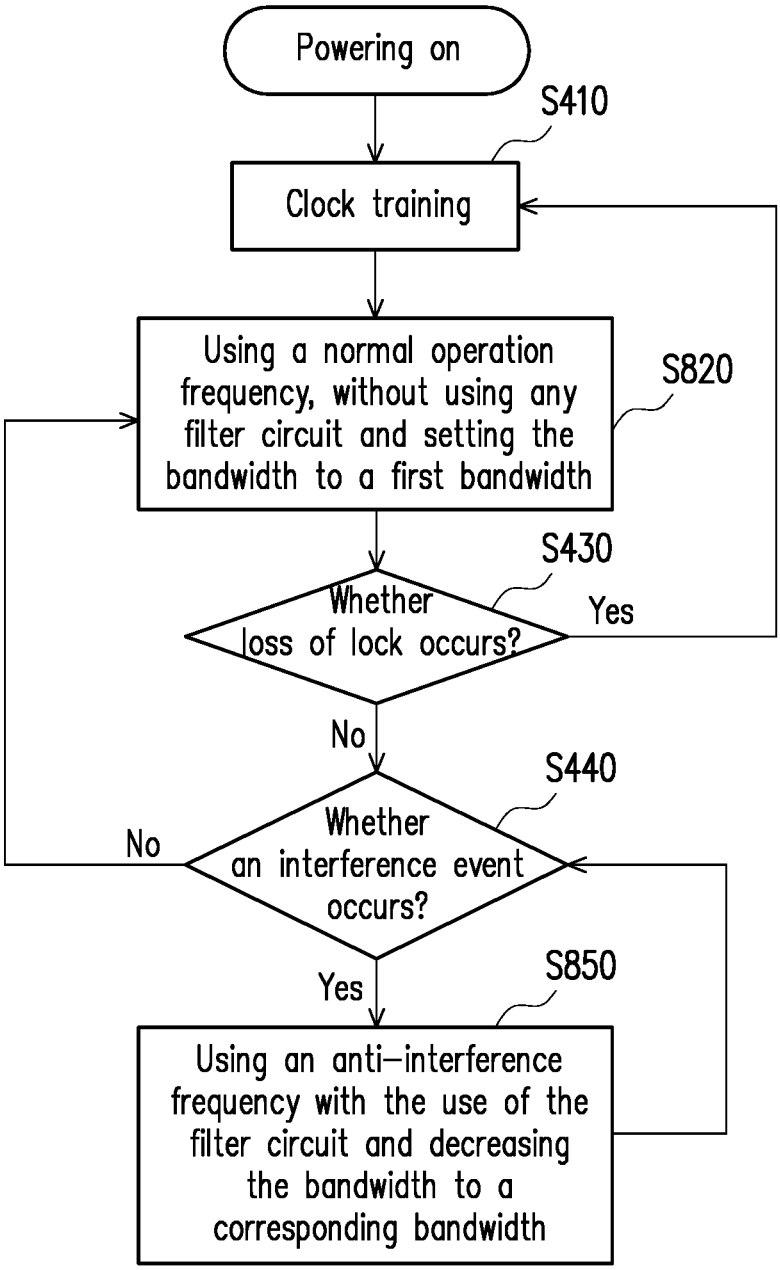
FIG. 11 is a flowchart illustrating an anti-interference method of a driving circuit according to yet another embodiment of the invention.

FIG. 11 is a flowchart illustrating an anti-interference method of a driving circuit according to yet another embodiment of the invention. Step S410, step S430 and step S440 illustrated in FIG. 11 may be inferred with reference to the description related to FIG. 4 and thus, will not be repeated. Referring to FIG. 10 and FIG. 11, in a normal mode (step S820), an operation frequency of the source driving circuit 700 is set to a normal operation frequency, and the output terminal of the filter circuit 710 provides the data signal Sdata (i.e., the input signal) to the input terminal of the receiving circuit 720 (without the use of any filter). The normal operation frequency may be determined based on a design requirement. Step S820 illustrated in FIG. 11 may be inferred with reference to the description related to step S420 illustrated in FIG. 4 and thus, other details will not be repeatedly described. In addition, when the interference event does not occur, the bandwidth of the receiving circuit 720 is set to the first bandwidth.

When the interference event occurs (i.e., the determination result of step S440 is "Yes"), the operation frequency (and/or the operation frequency of the timing controller 310) of the source driving circuit 700 may be adjusted from the normal operation frequency to the at least one anti-interference frequency (step S850). Step S850 illustrated in FIG. 11 may be inferred with reference to the description related to step S450 illustrated in FIG. 4 and thus, other details will not be repeatedly described. The source driving circuit 700, in step S850, may also filter the data signal Sdata with the use of the filter circuit 710 to obtain a filtered signal. In addition, when the interference event occurs to the data signal Sdata, in step S850, the bandwidth of the receiving circuit 720 is decreased from the first bandwidth to a certain corresponding bandwidth to avoid a frequency band of the interference event.

Figure 12:
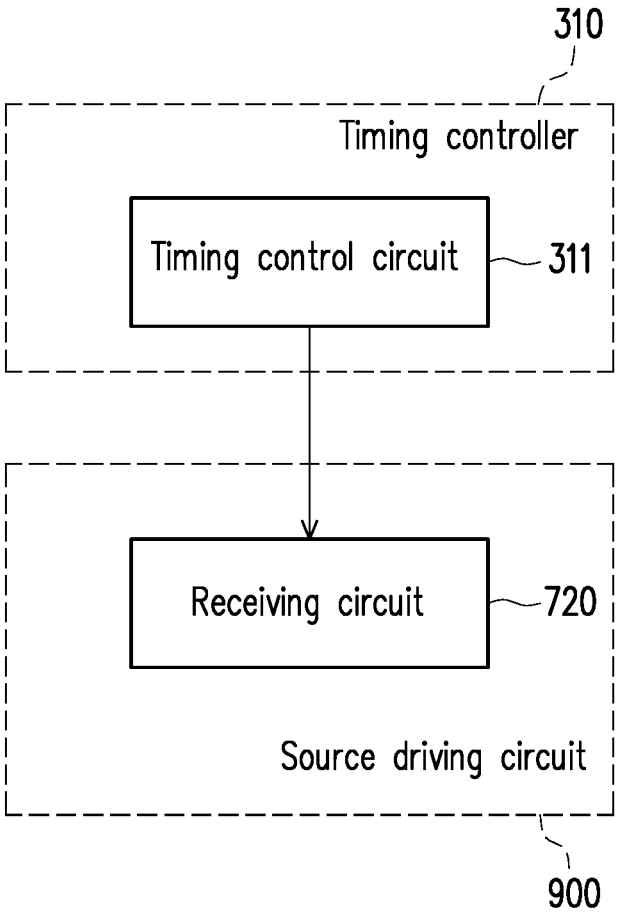
FIG. 12 is a schematic circuit block diagram illustrating a source driving circuit according to another embodiment of the invention.

FIG. 12 is a schematic circuit block diagram illustrating a source driving circuit 900 according to another embodiment of the invention. Any one of the source drivers 321 to 324 illustrated in FIG. 3 may be inferred with reference to the description related to the source driving circuit 900 illustrated in FIG. 12. The source driving circuit (the source driving circuit 900) comprises an input terminal configured to be coupled to the timing control circuit 311. The source driving circuit 900 illustrated in FIG. 12 includes a receiving circuit 720. The receiving circuit 720 comprises a phase locked loop (PLL) circuit (not shown) coupled to the input terminal of the source driving circuit 900. The receiving bandwidth of the source driving circuit (the source driving circuit 900) is adjusted within the receiving circuit 720, for example, by adjusting a configuration of the PLL circuit. An input terminal of the receiving circuit 720 may receive an input signal (e.g., the data signal Sdata) from the timing controller 310. The receiving circuit 720 may process the data signal Sdata based on a bandwidth of the receiving circuit to generate output data. When an interference event does not occur, the bandwidth of the receiving circuit 720 is set to a first bandwidth. When the interference event occurs to the data signal Sdata (i.e., the input signal), the bandwidth of the receiving circuit 720 is decreased from the first bandwidth down to a certain corresponding bandwidth.

Figure 13:
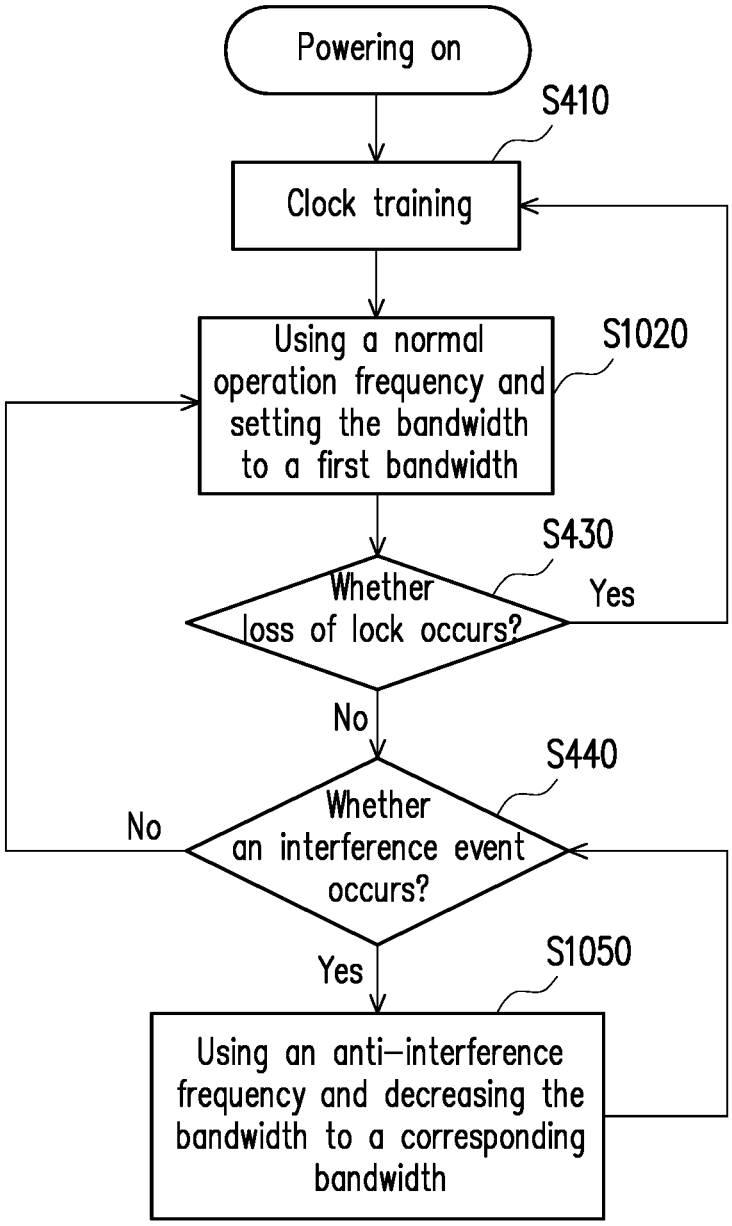
FIG. 13 is a flowchart illustrating an anti-interference method of a driving circuit according to still another embodiment of the invention.

FIG. 13 is a flowchart illustrating an anti-interference method of a driving circuit according to still another embodiment of the invention. Step S410, step S430 and step S440 illustrated in FIG. 13 may be inferred with reference to the description related to FIG. 4 and thus, will not be repeated. Referring to FIG. 12 and FIG. 13, in a normal mode (step S1020), an operation frequency of the source driving circuit 900 is set to a normal operation frequency. The normal operation frequency may be determined based on a design requirement. Step S1020 illustrated in FIG. 13 may be inferred with reference to the description related to step S420 illustrated in FIG. 4, and thus, other details will not be repeatedly described. In addition, when the interference event does not occur, the bandwidth of the receiving circuit 720 is set to the first bandwidth.

When the interference event occurs (i.e., the determination result of step S440 is "Yes"), the operation frequency of the source driving circuit 900 (and/or the operation frequency of the timing controller 310) may be adjusted from the normal operation frequency to the at least one anti-interference frequency (step S1050). Step S1050 illustrated in FIG. 13 may be inferred with reference to the description related to step S450 illustrated in FIG. 4, and thus, other details will not be repeatedly described. In addition, when the interference event occurs to the data signal Sdata, in step S1050, the bandwidth of the receiving circuit 720 is decreased from the first bandwidth down to a certain corresponding bandwidth to avoid a frequency band of the interference event.

Figure 14:
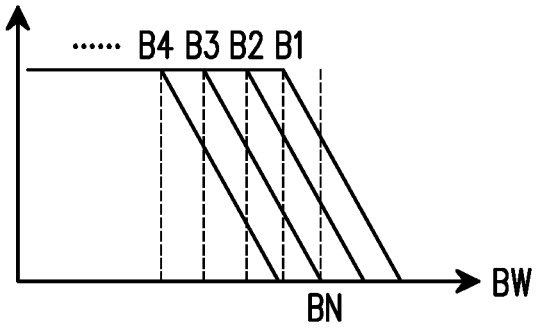
FIG. 14 is a schematic signal timing diagram illustrating that a bandwidth of the receiving circuit illustrated in FIG. 12 according to an embodiment of the invention.

FIG. 14 is a schematic signal timing diagram illustrating that a bandwidth BW of the receiving circuit 720 illustrated in FIG. 12 according to an embodiment of the invention. Referring to FIG. 12 and FIG. 14, the receiving circuit 720 further adjusts the bandwidth BW to avoid a frequency band BN of the interference event. For example, when the interference event does not occur, the receiving circuit 720 adjusts the bandwidth BW to "B1". When the interference event occurs, the receiving circuit 720 adjusts the bandwidth BW to one of "B2", "B3", "B4" and/or other bandwidth.

Figure 15:
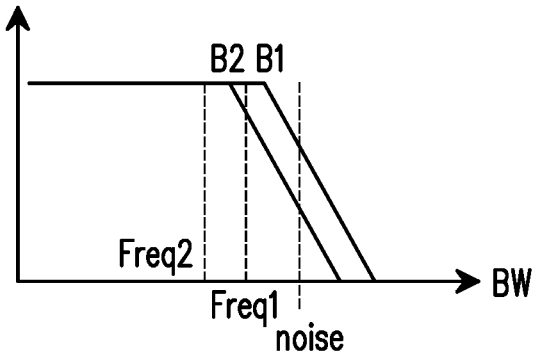
FIG. 15 is a schematic signal timing diagram illustrating that a bandwidth of the receiving circuit illustrated in FIG. 12 according to an embodiment of the invention.

FIG. 15 is a schematic signal timing diagram illustrating that a bandwidth BW of the receiving circuit 720 illustrated in FIG. 12 according to an embodiment of the invention. Referring to FIG. 12 and FIG. 15, the receiving circuit 720 adjusts the operation frequency and the bandwidth BW to avoid a frequency band BN of the interference event. For example, when the interference event does not occur, the receiving circuit 720 adjusts the bandwidth BW to "B1", and the operation frequency of the receiving circuit 720 is set to a frequency value "Freq1". When the interference event occurs, the receiving circuit 720 adjusts the bandwidth BW to "B2", and the operation frequency of the receiving circuit 720 is set to a frequency value "Freq2".

Figure 16:
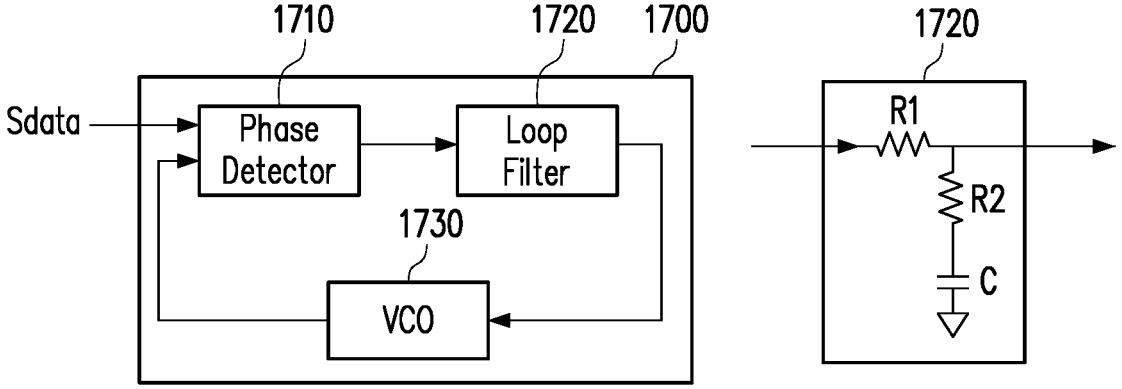
FIG. 16 is a schematic circuit block diagram illustrating a phase locked loop (PLL) circuit in the receiving circuit according to an embodiment of the invention.

FIG. 16 is a schematic circuit block diagram illustrating a phase locked loop (PLL) circuit 1700 in the receiving circuit 720 according to an embodiment of the invention. The PLL circuit 1700 includes a phase detector 1710, a loop filter 1720, and a voltage-controlled oscillator (VCO) 1730. The PLL circuit 1700 is capable of generating an output clock signal to the source driving circuit 900. The configuration of the loop filter 1720 is adjusted to adjust the receiving bandwidth of the source driving circuit 900. In the embodiment of FIG. 16, the loop filter 1720 includes a resistor R1, a resistor R2 and a capacitor C. The bandwidth of the receiving circuit 720 is ¼C(R1+R2). The bandwidth of the receiving circuit 720 can be changed by changing the resistance value of the resistor R2.

In light of the foregoing, at least one of the timing controller and the source driver can be configured to determine whether or not an interference event occurs to an input signal. When the interference event occurs, at least one of operating parameters (such as an operation frequency, and/or a receiving bandwidth) of the source driving circuit can be dynamically adjusted to avoid the frequency band of the interference event. Different combinations of the above adjustment operations can be performed to mitigate the influence of the interference event. More specifically, one or multiples of the following adjustment operations can be made: adjusting the operation frequency of the source driving circuit and adjusting the receiving bandwidth of source driving circuit, wherein the adjusting of the receiving bandwidth of the source driving circuit may be performed by at least one of the following operation, adjusting a bandwidth of a receiving circuit of source driving circuit, enabling a filter circuit of the source driving circuit, and adjusting a bandwidth of the filter circuit of the source driving circuit. The filter circuit may be arranged prior to the receiving circuit of the source driving circuit.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A driving circuit for driving a display panel, comprising:

a source driver, configured to be controlled by a timing controller, wherein the source driver is configured to adjust at least one of an operation frequency and a receiving bandwidth of a source driving circuit of the source driver when at least one of the timing controller and the source driver detects that an interference event occurs.

2. The driving circuit as recited in claim 1, wherein the source driver is configured to receive an indication signal from the timing controller and adjust the at least one of the operation frequency and the receiving bandwidth of the source driving circuit according to the indication signal, wherein the indication signal indicates whether or not the timing controller detects that the interference event occurs.

3. The driving circuit as recited in claim 2, wherein the indication signal comprises a data signal or a clock signal indicating or having a frequency according to which the operation frequency is adjusted.

4. The driving circuit as recited in claim 1, wherein the source driver comprises an interference detection circuit configured to receive an input signal from the timing controller and detects whether or not the interference events occurs to the input signal.

5. The driving circuit as recited in claim 4, wherein the interference detection circuit is further configured to generate a feedback signal when the source driver detects that the interference events occurs to the input signal, wherein the feedback signal is configured to be provided to the timing controller.

6. The driving circuit as recited in claim 5, wherein the feedback signal is a hardware pin signal.

7. The driving circuit as recited in claim 5, wherein the feedback signal is a differential signal.

8. The driving circuit as recited in claim 5, wherein the feedback signal is a differential signal including a first end signal and a second end signal.

9. The driving circuit as recited in claim 1, wherein the operation frequency of the source driving circuit is a frequency indicated by a clock signal or a data signal, wherein the clock signal or the data signal is served as the indication signal and received by the source driver from the timing controller.

10. The driving circuit as recited in claim 1, wherein the source driver is configured to adjust the operation frequency from a normal operation frequency to at least one anti-interference frequency when interference event occurs, and the source driver is configured to maintain the operation frequency of the source driver at the normal operation frequency when the interference event does not occur.

11. The driving circuit as recited in claim 10, wherein the source driver is configured to adjust the operation frequency of the source driving circuit from the at least one anti-interference frequency to the normal operation frequency when the interference event disappears.

12. The driving circuit as recited in claim 1, wherein the source driver comprises an input terminal configured to be coupled to the timing controller and a receiving circuit coupled to the input terminal, and the receiving bandwidth of the source driving circuit is adjusted before the receiving circuit.

13. The driving circuit as recited in claim 1, wherein the source driver comprises an input terminal configured to be coupled to the timing controller and a receiving circuit coupled to the input terminal, and the receiving bandwidth of the source driving circuit is adjusted within the receiving circuit.

14. The driving circuit as recited in claim 12, wherein the source driver further comprises a filter circuit configured to be coupled between the timing controller and the receiving circuit and to perform a filtering operation on an input signal received from the timing controller so as to adjust the receiving bandwidth of the source driving circuit when the interference event occurs.

15. The driving circuit as recited in claim 14, wherein the filter circuit is configured not to perform the filtering operation on the input signal received by the source driver when the interference event does not occur.

16. The driving circuit as recited in claim 14, wherein a bandwidth of the filter circuit is further configured to be adjusted based on a noise frequency of the interference event when the interference event occurs.

17. The driving circuit as recited in claim 13, wherein the receiving circuit further comprises a phase locked loop circuit, wherein a configuration of the PLL circuit is adjusted to adjust a bandwidth of the receiving circuit so as to adjust the receiving bandwidth of the source driving circuit.

* * * * *